United States Patent [19]

Kitt

[11] Patent Number: 4,870,847

[45] Date of Patent: Oct. 3, 1989

[54] METHOD AND APPARATUS FOR FORMING OUTWARDLY PROJECTING BEADS ON CYLINDRICAL OBJECTS

[75] Inventor: Martin P. Kitt, Arvada, Colo.

[73] Assignee: Ihly Industries, Inc., Englewood, Colo.

[21] Appl. No.: 196,952

[22] Filed: May 20, 1988

[51] Int. Cl.[4] ..... B21D 19/12

[52] U.S. Cl. ..... 72/84; 72/105

[58] Field of Search ..... 72/84, 85, 91, 94, 105, 72/106, 110

[56] References Cited

U.S. PATENT DOCUMENTS

| | | | |
|---|---|---|---|
| 1,597,206 | 8/1926 | Mallory . | |
| 3,418,837 | 12/1968 | Vanderlaan et al. . | |
| 3,469,428 | 9/1969 | Aschberger . | |
| 3,531,967 | 10/1970 | Werge . | |
| 3,581,543 | 6/1971 | Hock et al. | 72/105 |
| 3,595,048 | 7/1971 | Holt | 72/84 |
| 3,648,503 | 3/1972 | Harper | 72/84 |
| 3,688,538 | 9/1972 | Hoyne . | |
| 3,754,424 | 8/1973 | Costanzo . | |
| 3,998,174 | 12/1976 | Saunders . | |
| 4,058,998 | 11/1977 | Franek et al. . | |
| 4,070,888 | 1/1978 | Gombas . | |
| 4,246,770 | 1/1981 | Franek et al. . | |
| 4,331,014 | 5/1982 | Miller et al. . | |
| 4,341,103 | 7/1982 | Escallon et al. . | |
| 4,487,048 | 12/1984 | Frei . | |
| 4,563,887 | 1/1986 | Bressan et al. . | |
| 4,781,047 | 11/1988 | Bressan et al. . | |

OTHER PUBLICATIONS

International Digest, Metal box Engineering, Spring 1988.

VB 20 High Precision Vertical Beader, Frei Ag Maschinebau.

Description of the Krupp Vertical Beader.

Descriptions of Carnation 12 Spindle Rotary Can Beaders, Models 201 and 202, Carnation Company, Can Division.

Press Release from Jan. 24–28, 1987, "International Exposition of Food Processors and Annual Convention of National Food Processors".

Tin International, p. 70, Mar. 1987.

Modern Metals, p. 68, Apr. 1987.

*Primary Examiner*—Lowell A. Larson

*Attorney, Agent, or Firm*—Sheridan, Ross & McIntosh

[57] ABSTRACT

A method and apparatus are disclosed for forming an outwardly projecting bead in the sidewall of a cylindrical object. The apparatus includes an inner forming member and an outer forming member having a leading forming surface, a trailing support surface, and a recess therebetween. The method includes forcing the sidewall of the container in a radially outward direction by applying a force to the inside of the sidewall, and limiting the resulting projection to a desired sidewall region to form an outwardly projecting bead in the container sidewall.

27 Claims, 3 Drawing Sheets

METHOD AND APPARATUS FOR FORMING OUTWARDLY PROJECTING BEADS ON CYLINDRICAL OBJECTS

FIELD OF THE INVENTION

This invention is related to the field of configuring cylindrical objects, and more specifically to forming an outwardly projecting bead on a spinning cylindrical object.

BACKGROUND OF THE INVENTION

Cylindrical objects, such as containers and cans, are available in a variety of types and configurations. Two of the more common types are two-piece containers and three-piece containers. Two-piece containers are typically manufactured by a drawing and ironing process. In such processes a cup-shaped metal blank is drawn, optionally redrawn, then passed through successive ironing rings in order to lengthen and thin the sidewalls of the container. The open end of the two-piece container is then closed with a separate end piece. Three-piece containers are typically manufactured from metal roll stock that is cut into strips having a width that will substantially define the height of the resultant containers. Each strip is formed into a cylindrical shape and a longitudinal seam is established, e.g. by welding. The two open ends are then closed by attaching end pieces.

It is often desirable to alter the configuration of the sidewalls of cylindrical containers, including two-piece and three-piece containers, during the manufacturing process. For instance, the open end or ends of a container may be flanged in order to facilitate the attachment of end pieces. Additionally, the "necking-in" (i.e. reduction of diameter) of at least one end of the sidewalls of containers in order to reduce the material required for closing and sealing has become or is becoming standard practice for many container applications.

Another desirable configuration modification is the incorporation of one or more beads in the sidewalls of containers. Such beads can serve a number of useful functions, depending on their cross-sectional configuration and location on the sidewall.

For example, beads can increase the sidewall strength of a container, which is especially advantageous for containers fabricated from lightweight materials. As a result of the stronger sidewall, the container can withstand rough treatment in handling and transportation.

An outwardly projecting bead is also advantageous on containers having labels. For instance, if the outwardly projecting bead is placed at one or both ends of the container it can help prevent the label from sliding up or down along the longitudinal axis of the container. Additionally, by providing a recess for the label, the outwardly projecting bead can help protect the label when the container is rolled across a surface. These advantages can result in improved marketability and increased sales of the product packaged in the container.

Due to their method of manufacture, some containers will have different diameters at their two ends. For example, when a three-piece container is manufactured, it may have a flange and connected end piece at the bottom of the container which protrude laterally beyond the sidewall. On the other hand, the top flange and connected end piece may not laterally extend as far because the top may have been necked-in prior to flanging and attachment of the end piece. As a result of the different diameters at the two ends, the container will not roll straight on material handling equipment surfaces. An outwardly projecting bead placed near the top of the container can substantially equalize the diameters, thereby allowing the container to roll straight, easing and expediting the handling process.

It is known to form beads in a container sidewall by positioning opposing, mating die members adjacent to the interior and exterior surfaces of a container sidewall, and causing relative movement of the die members radially towards each other to bead the sidewall therebetween. For example, U.S. Pat. No. 4,487,048 by Frei et al. issued Dec. 11, 1984, discloses a method for beading the bodies of metal containers by rolling the container bodies between an inner tool and an outer tool, for instance, inner and outer mating rolls, in order to increase the container body sidewall strength. The inner tool has an expandable body and the container is rotated by rotating the inner tool after insertion and expansion within the container. The outer tool moves radially inward toward the inner tool to carry out the beading operation. Specifically, the outer tool is rolled upon the intermediately, radially inward disposed container body in order to force the container body to conform to the bead configuration of the mating surfaces.

It is believed that known beading methods have not been employed simultaneously with known container sidewall configuring processes which require relative axial (e.g. camming) movement between forming members positioned on opposing sides of a container sidewall. Additionally, it is believed that known beading devices cannot be successfully employed simultaneously or sequentially with such configuring processes to consistently form outwardly projecting beads at a desired location immediately adjacent to necked-in portions of container body sidewalls.

With particular respect to the present invention, it is known to vary the diameter of cylindrical objects, e.g. necking-in, by employing a spin forming process wherein the cylindrical objects are spun about their longitudinal axes while the sidewalls thereof are contacted by inner and/or outer forming members. U.S. Pat. No. 3,688,538 by Hoyne issued Sept. 5, 1972; U.S. Pat. No. 4,070,888 by Gombas issued Jan. 31, 1978; U.S. Pat. No. 4,563,887 by Bressan et al. issued Jan. 14, 1986; and U.S. patent application Ser. No. 858,774 by Bressan et al. filed May 2, 1986, now U.S. Pat. No. 4,781,047 issued Nov. 1, 1988, all disclose methods for necking-in cylindrical objects using spin forming methods. As indicated above, the necking-in of container bodies has or is becoming standard practice for many container applications. The above-referenced spin forming U.S. Pat. Nos. 4,563,887 and 4,781,047 are hereby incorporated by reference in their entirety. None of the spin forming references noted above disclose a method or apparatus for forming an outwardly projecting bead in the sidewall of a container before, during or after spin forming.

In view of the foregoing, it should be appreciated that it would be advantageous to consistently and reliably form outwardly projecting beads immediately adjacent to inwardly projecting, necked-in portions of container sidewalls. Further, it would be advantageous to form such outwardly projecting beads in the same operation during which the inwardly projecting, necked-in portions are formed. Additionally, it would be advantageous to form outwardly projecting beads in conjunction with a spin forming process.

SUMMARY OF THE INVENTION

The present invention provides a novel method and apparatus for forming an outwardly projecting bead in the sidewall of a cylindrical object. The invention may be employed in combination and simultaneously with known spin forming processes, and allows for precise positioning of beads relative to necked-in portions of container body sidewalls.

The method of the present invention includes the steps of supporting the interior side of the sidewall of a spinning cylindrical object and applying pressure to the exterior side of the sidewall. The interior support is provided adjacent the area where the outwardly projecting bead is to be formed. During the process pressure is applied to the exterior of the container sidewall at longitudinally and radially progressing locations on each lateral side of the inner support means. The longitudinal distance between such locations, together with the longitudinal width of the inner support means, substantially determines the longitudinal width of the bead to be formed. The means for providing pressure to the exterior side of the sidewall moves radially inward and longitudinally relative to the sidewall until, when the outwardly projecting bead forming process is complete, the pressure providing means is adjacent both lateral sides of the inner support means and also projects radially inward beyond the outer periphery of the inner support means. The radial distance that the exterior pressure providing means is located inward relative to the radially outermost portion of the inner support means is a major factor in determining the amount of outward projection of the resulting bead. Following the beading operation, the cylindrical object is released from between the inner support means and the outer pressure providing means. The shape and size of the bead may change slightly when the cylindrical object is released, depending upon the resiliency of the material out of which the cylindrical object is fabricated.

The novel apparatus of the present invention includes an inner forming member and an outer forming member. The inner forming member has a radially outwardly projecting peripheral forming surface which supports the interior of the sidewall during the forming process. The outer forming member includes a trailing support surface and a leading support surface for engaging and applying pressure to the exterior side of the sidewall, the two support surfaces being separated by a recess for receiving and restricting an outwardly projecting sidewall region. Means are provided to spin the cylindrical object about its longitudinal axis.

The method and apparatus of the present invention have a number of advantages. For example, an outwardly projecting bead can be formed in the sidewall of a cylindrical object immediately adjacent to a radially inwardly projecting necked-in portion. The relative positions of the outwardly projecting bead and the necked-in portion can be controlled with a high degree of accuracy. Additionally, an outwardly projecting bead and a radially inwardly projecting necked-in portion may be formed in a single spin forming operation.

BRIEF DESCRIPTION OF THE DRAWINGS

The present invention may best be understood by reference to the following description taken in conjunction with the accompanying drawings in which.

DETAILED DESCRIPTION OF THE INVENTION

Figure 1:
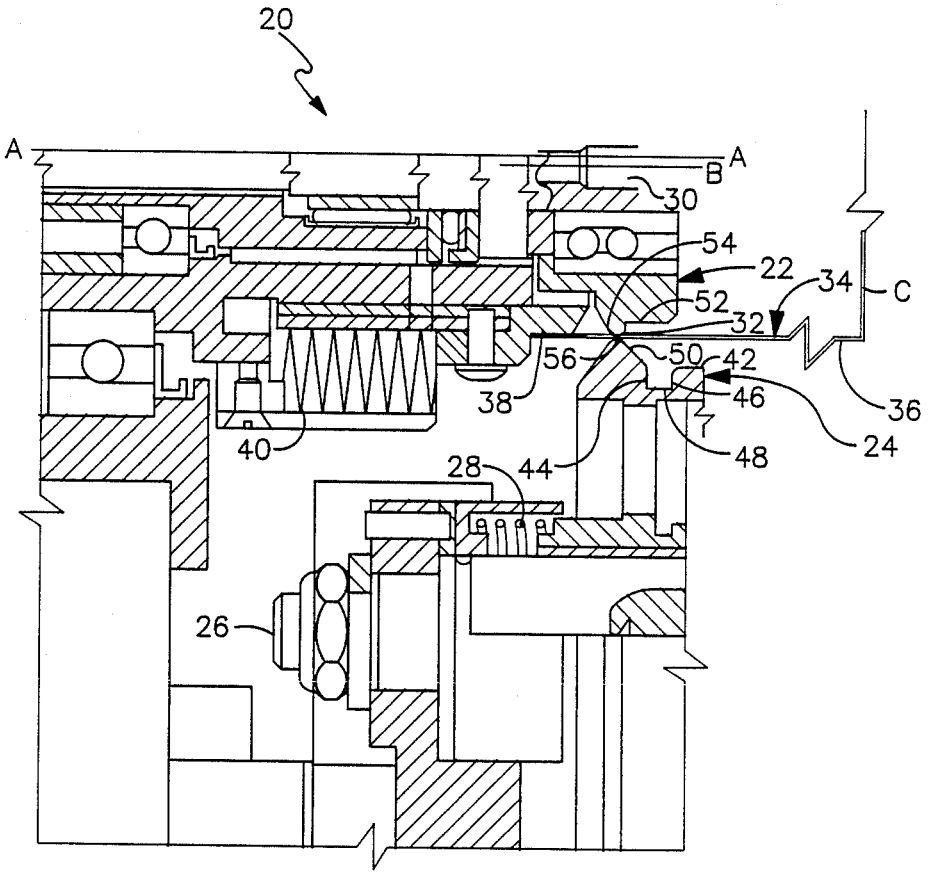
FIG. 1 is a side view of a tooling arrangement for configuring cylindrical objects, including a preferred embodiment of the apparatus of the present invention.

The apparatus and method of the preferred embodiment of the present invention will be described with reference to FIG. 1. In FIG. 1, a tooling assembly 20 is shown having an inner forming member 22 and an outer forming member 24. While the preferred embodiment is shown with respect to a container C having an open end disposed towards assembly 20 and a closed end, it should be appreciated that a container having both ends open could also be beaded in accordance with the present invention.

The outer forming member 24 is mounted for free rotation on a mandrel 26, and is able to slide axially along the mandrel 26 against the urgings of a coil compression spring 28 in reaction to longitudinal forces applied to the outer forming member 24 during the disclosed process. The mandrel 26 and outer forming member 24 supported thereon are interconnected with means for controlled movement toward and away from the longitudinal axis A of the container C, such as, for example, by a timed cam means.

The inner forming member 22 is mounted on a shaft 30 having a center axis B that is offset to one side of the axis A. Known means are provided for moving the shaft 30 and inner forming member 22 towards and away from the interior surface 34 of sidewall 36 of the container C. The inner forming member 22 is supported for free rotation about axis B and is restrained from axial movement. The inner forming member 22 has an outer peripheral forming surface 32 which, in operation, contacts and supports the interior surface 34 of the sidewall 36 of container C during the bead forming process.

Means are provided to support and rotate the container C about its longitudinal axis A. For example, the closed end of the container C can be supported by vacuum means or mechanical clamp means (not shown). The end of the container C closest to the assembly 20 is supported on a holder 38. The holder 38 is biased towards the inner forming member 22 by compression springs 40. During the configuring process the holder 38 may move in an axial direction away from the inner forming member 22, in response to longitudinal forces applied to holder 38 by the outer forming member 24. Either one or both of &:he holder 38 and support means provided at the other end of the container C can be driven to rotate, or spin, the container C about its longitudinal axis A.

The outer forming member 24 has a peripheral forming surface 56, a trailing support surface 42, an interfacing surface 50, and a recess defined by side surfaces 44 and 46 and bottom surface 48. As will be appreciated, the longitudinal width of the recess must be greater than the widest portion of the outer peripheral forming surface 32 of the inner forming member 22 that protrudes into the recess during the disclosed bead forming process. In addition to a peripheral forming surface 32, the inner forming member 22 may optionally include a trailing support surface 52. Preferably the outer forming member 24 and the inner forming member 22 have mating, sloped surfaces 50 and 54 in order to interface to form a necked-in portion on the container sidewall 36, adjacent to where the outwardly projecting bead is to be formed.

In use, a container C is mounted on the assembly 20 for rotation about the container's longitudinal axis A. Initially the peripheral forming surface 32 of the inner forming member 22 is brought into contact with the interior surface 34 of the spinning container C and rotates relative thereto. In certain applications, it may be desirable to begin the beading process by positioning the inner forming member 22 so that the outermost extent of the peripheral forming surface 32, and the interfacing container sidewall portion, extend beyond the plane initially defined by the adjacent sidewall region of container C prior to the start of the beading process. The outer forming member 24 is moved in a radial direction towards the container C. The outer peripheral nose 56 of the outer forming member 24 initially contacts the container C substantially opposite the peripheral forming surface 32 of the inner forming member 22. Such contact causes the outer forming member 24 to rotate about mandrel 26. As the outer forming member 24 continues radially inward, external pressure is applied to the sidewall 36. Furthermore, the opposing interface between the mating surfaces 54 and 50 on the inner forming member 22 and the outer forming member 24, respectively, squeezes, or restricts, the container sidewall therebetween and forces the outer forming member 24 in an axial direction towards the open end of the container C supported by holder 38.

The continued inward and simultaneous axially forward motion of the outer forming member 24 allows the support surface 42 of the outer forming member 24 to contact and apply external pressure to the container sidewall 36. The region of contact moves radially inward and axially towards the open end of container C. As the outer forming member 24 continues radially inward and axially forward, the portion of the container sidewall 36 which contacts the peripheral forming surface 32 of the inner forming member 22 is shaped by the peripheral forming surface 32. This outwardly projecting portion of the sidewall 36 protrudes into the recess of the outer forming member 24, which limits the outward projection to a desired longitudinal region of the sidewall 36, thereby forming an outwardly projecting bead therein. As will be appreciated, the dimensions of the recess must be such that the peripheral forming surface 32 can be accommodated therein during the entire, disclosed process. Although the figures show the recess to be substantially rectangular in shape, it can assume other shapes as well, as long as the outer peripheral forming surface 32 can be accommodated within the recess as the outer forming member 24 moves radially inward and axially forward. The limitation of the outward projection of the container sidewall 36 to a desired longitudinal region may be optionally further effected by causing the outer forming member 24 to move radially inward until the container sidewall 36 is rolled, or squeezed, between the support surface 42 of the outer forming member 24 and the optional trailing support surface 52 of the inner forming member 22. The process described above can be further understood by referring to FIGS. 3–6, which are discussed below.

As can be appreciated, an outwardly projecting bead can be formed in the sidewall of a container utilizing the present invention, while simultaneously necking-in an immediately adjacent portion of the container. Further, those skilled in the art will appreciate that the diameter and length of a bead can be selectively provided for by adjusting the relative dimensions of the above-discussed features of the inner forming member 22 and outer forming member 24.

Figure 2:
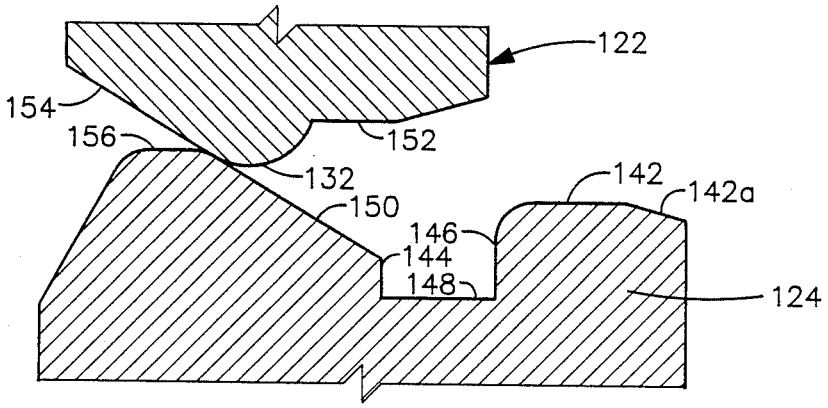
FIG. 2 is a partial cross-sectional view of one embodiment of the inner and outer forming members of the present invention.

FIG. 2 shows partial cross-sectional views of another embodiment of an inner forming member 122 and an outer forming member 124. The inner forming member 122 has a sloping radially inwardly projecting leading surface 154, a peripheral forming surface 132 and an optional trailing support surface 152. The outer forming member 124 has a peripheral forming surface 156, a radially inwardly sloping interfacing surface 150, a recess defined by the interfacing surface 150, sidewalls 144 and 146 and bottom wall 148, and a trailing surface 142. A portion of the trailing surface 142 can be shaped to provide a sloping trailing surface 142*a* to accommodate the inward angulation of the container body sidewall during the process of the present invention. The inward angulation results from the radially inward pressure applied to the exterior of the sidewall by the outer forming member 124.

Figure 3:
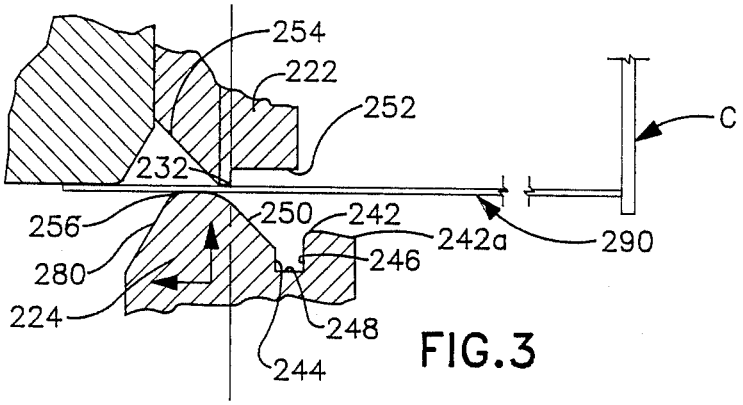
FIGS. 3 through 6 illustrate partial cross-sectional views of another embodiment of the inner and outer forming rolls, and also illustrate successive steps in the disclosed bead forming process.

FIGS. 3 through 6 show another embodiment of the inner forming member 222 and the outer forming member 224 at successive stages of the disclosed process. The members 222 and 224 are shown in partial cross-section. In FIG. 3 the inner forming member 222 has a radially inwardly sloping leading surface 254, an outer peripheral forming surface 232 and an optional trailing surface 252. The outer forming member 224 has a sloping foward surface 280, a peripheral forming surface 256, a radially inwardly sloping interfacing surface 250 which is configured to cooperate with the leading surface 254 of the inner forming member 222, a recess defined by interfacing surface 250, sidewalls 244 and 246 and bottom wall 248, and a trailing surface 242 having a sloping trailing surface portion 242*a*. FIG. 3 illustrates the positional relationship of the inner and outer forming members 222 and 224 as the outer forming member 224 initially contacts the exterior sidewall surface 290 of the container C.

Figure 4:
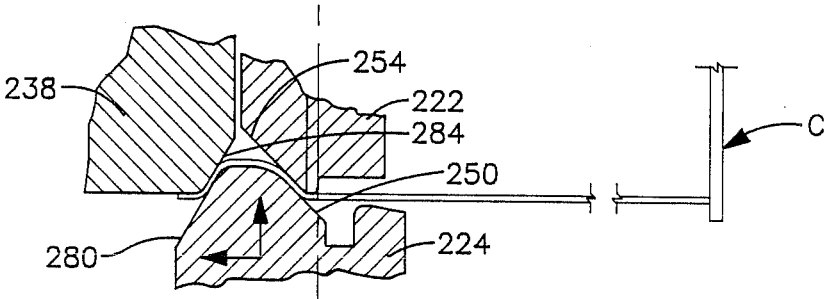

In FIG. 4 the outer forming member 224 has moved radially inward to squeeze the container C sidewall between the sloping interfacing surface 250 of the outer forming member 224 and the sloping leading surface 254 of the inner forming member 222. The interface, or camming, of the two mating surfaces 250 and 254 forces the outer forming member 224 to move towards the open end of container C, thereby necking-in the container sidewall. Additionally, in the shown embodiment, the sloping forward surface 280 of the outer forming member 224 has interfaced with the sloping surface 284 of the holder 238 to initiate the spin forming of an outward flange in the sidewall portion therebetween.

Figure 5:
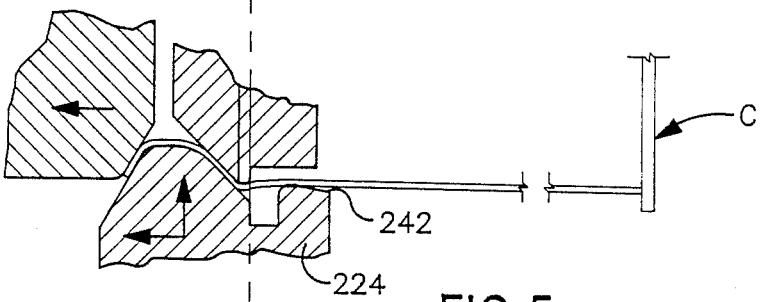

FIG. 5 shows the outer forming roller 224 having further moved radially inward and axially towards the open end of the container C. In FIG. 5 the trailing surface 242 of the outer forming member has contacted the exterior sidewall surface 290 of the container C.

Figure 6:
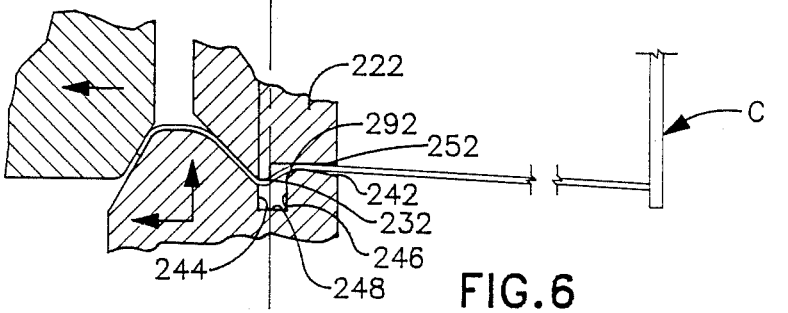

In FIG. 6 portions of the sidewall of container C have been forced radially inward by interfacing surface 250 and trailing surface 242 of the outer forming member 224. As a result, the outer peripheral forming surface 232 forms an outwardly projecting bead in the portion of the sidewall of container C located between surfaces 242 and 250 and contacted by peripheral forming surface 232. As shown in FIG. 6, the trailing surface 242 may optionally interface with the trailing surface 252 of the inner forming member 222, to squeeze the container sidewall therebetween. As can be appreciated, the rounded edge 292 between the wall 246 and trailing surface 242 of the outer forming member 224 will substantially define the lower boundary of the sidewall region in which the outwardly projecting bead is formed.

Figure 9:
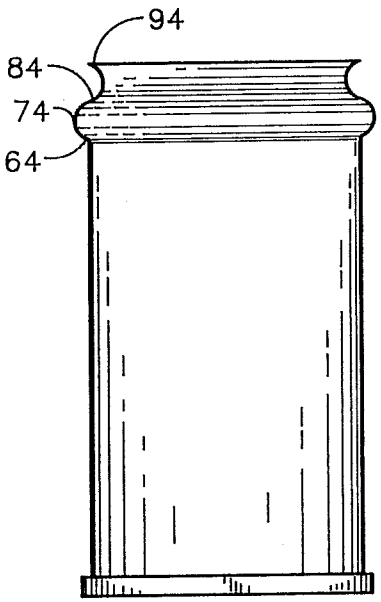
FIGS. 7 through 9 show front plan views of three different container configurations in which an outwardly projecting bead has been formed immediately adjacent to a necked-in and flanged portion of an open end of a container.
Figure 8:
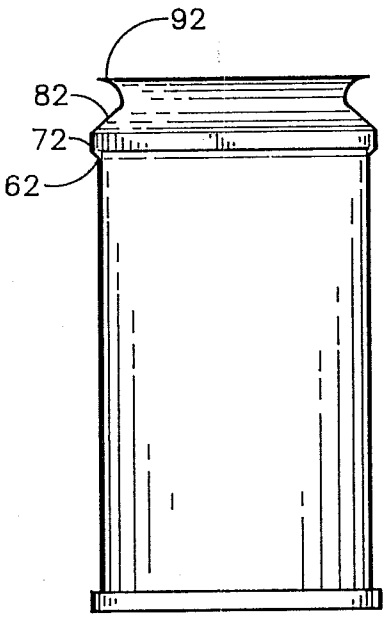
Figure 7:
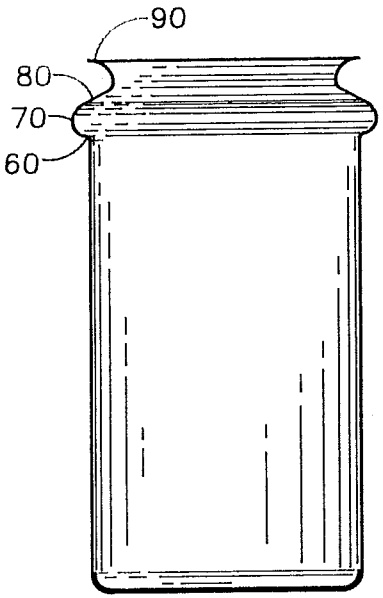

FIGS. 7, 8, and 9 illustrate three different configurations of outwardly projecting beads achievable with the present invention. In FIG. 7 an outwardly projecting bead is shown on a two-piece can, and in FIGS. 8 and 9 outwardly projecting beads are shown on three-piece cans. In these figures the innermost boundary of the outwardly projecting bead is shown as 60, 62 and 64. The radially outermost point on the outwardly projecting bead is shown as 70, 72 and 74. The transition region between the outwardly projecting bead and a necked-in region of the can is shown as 80, 82 and 84. A flange portion of the can is shown as 90, 92 and 94.

While various embodiments of the present invention have been described in detail, it is apparent that further modifications and adaptations of the invention will occur to those skilled in the art. However, it is to be expressly understood that such modifications and adaptations are within the spirit and scope of the present invention.

What is claimed is:

1. A method for forming an outwardly projecting bead in the sidewall of a cylindrical object, said method comprising:

(a) supporting a cylindrical object for rotation;
(b) rotating said cylindrical object about its longitudinal axis;
(c) supporting an interior portion of the cylindrical object sidewall adjacent to where the outwardly projecting bead is to be formed;
(d) providing a recess adjacent to an exterior portion of said sidewall;
(e) applying pressure to exterior portions of said sidewall which are adjacent to each side of said recess; and
(f) pressing said exterior of said sidewall in a direction radially inward and axially forward until an outwardly projecting bead is formed in said sidewall.

2. A method for forming an outwardly projecting bead in the sidewall of a cylindrical object, said method comprising:

(a) spinning said cylindrical object about its longitudinal axis;
(b) providing radially and axially fixed inner forming means adjacent a portion of the interior surface of said sidewall;
(c) providing outer support means to support two portions of the exterior surface of said sidewall at least during the final stages of the outwardly projecting bead forming process; and
(d) moving said outer support means radially inward and axially forward until said inner forming means protrudes radially outwardly between said two sidewall portions supported by said outer support means.

3. The method as claimed in claim 2 further comprising the step of forming a necked-in portion in said sidewall.

4. The method as claimed in claim 2 further comprising the step of forming a flange on a portion of said sidewall nearest an open end of said cylindrical object

5. The method as claimed in claim 2 further comprising the step of providing a second inner forming means which is movable in an axial direction.

6. The method as claimed in claim 5 further comprising the step of forming a flange in the sidewall of the cylindrical object by squeezing said sidewall between an outer forming means and said second inner forming means.

7. The method as claimed in claim 6 wherein said second inner forming means moves in an axial direction away from the button of said cylindrical object during the forming process.

8. A method for forming an outwardly projecting bead adjacent to a necked-in portion in a sidewall section of a spinning cylindrical object having at least one open end, said sidewall section having an innermost extreme relative to said open end of said cylindrical object and having a transition portion located closer to said open end than said innermost extreme, said method comprising the following steps:

(a) squeezing said sidewall section of said spinning cylindrical object at an initial location of said transition portion;
(b) configuring a necked-in portion into said sidewall section closer to said open end than said transition portion by moving the location of said squeezing radially inward and axially toward said open end;
(c) pressing a portion of the interior side of said cylindrical object sidewall located further from said open end than said transition portion in a radially outward direction relative to the longitudinal axis of the unconfigured portion of said sidewall;
(d) providing a recess adjacent the exterior side of said sidewall into which the outwardly pressed portion protrudes; and
(e) substantially supporting the exterior of said sidewall substantially at said innermost extreme.

9. The method as claimed in claim 8 wherein said method includes providing a first axially and radially fixed inner forming means, a second inner forming means movable in axial and radial direction.

10. The method as claimed in claim 9 wherein said transition portion of said sidewall section is squeezed between said outer forming means and said first inner forming means and wherein said recess is provided in said outer forming means.

11. The method as claimed in claim 8 further comprising the step of forming a flange in said open end of said cylindrical object.

12. A method as claimed in claim 11 wherein said flange is formed by squeezing a portion of said sidewall between said outer forming means and said second inner forming means.

13. A method for forming an outwardly projecting bead in the sidewall of a cylindrical object, said outwardly projecting bead having an innermost boundary adjacent a substantially unformed sidewall portion, said method comprising:

(a) rotating said container about its longitudinal axis;

(b) supporting an interior portion of the rotating sidewall with an inner forming means in an area where the outwardly projecting bead is to be formed, said area being closer to an open end of said cylindrical object than said innermost boundary;

(c) contacting an exterior surface of the rotating sidewall with an outer forming means at a point located further from the open end of the container than the innermost boundary;

(d) deforming said container by moving said outer forming means radially inward towards the longitudinal axis of the container and axially forward toward the open end of the container;

(e) squeezing said rotating sidewall between said outer forming member and an inner squeeze surface at a first axial location substantially within the plane of said innermost boundary and radially inward of an outermost portion of said inner forming means; and (f) squeezing said rotating sidewall at a second axial location closer to said open end of said container than said innermost boundary.

14. The method as claimed in claim 13 further comprising the step of forming a flange near the open end of said cylindrical object.

15. The method as claimed in claim 14 wherein said flange is formed between said outer forming means and a second inner forming means.

16. The method as claimed in claim 15 wherein said second inner forming means is movable in an axial direction.

17. The method of claim 13 further comprising a method for configuring a necked-in portion of said sidewall adjacent to said outwardly projecting bead and located closer to said open end than said outwardly projecting bead, said method further comprising:

(g) configuring a necked-in portion in said sidewall section of said spinning container body by squeezing substantially throughout the configuring step at least some portion of said sidewall section that is located closer to said open end of said spinning cylindrical object than said second axial location.

18. An apparatus for forming an outwardly projecting bead in the sidewall of a spinning cylindrical object comprising:

(a) a freely rotatable inner forming member having:

(i) an outer peripheral forming surface; and (ii) a first radially inwardly sloping surface located axially adjacent to said outer peripheral forming surface;

(b) an outer forming member capable of radial and axial movement and having:

(i) a second radially inwardly sloping surface configured to cooperate with said first radially inwardly sloping surface of said inner forming member to restrict said sidewall therebetween; and (ii) a trailing support surface.

19. The apparatus of claim 18 wherein said outer forming member further comprises a recess located between said second sloping surface and said trailing support surface.

20. The apparatus of claim 19 wherein said recess is dimensioned to accommodate said outer peripheral forming surface during a spin forming process.

21. The apparatus of claim 18 wherein said outer forming member further comprises a forward sloping surface configured to form a flange in said sidewall.

22. The apparatus of claim 18 wherein said inner forming member further comprises an inner trailing support surface.

23. The apparatus of claim 18 wherein said trailing support surface of said outer forming member further comprises a sloping trailing surface portion to accommodate the angulation of the sidewall during a spin forming process.

24. The apparatus as claimed in claim 18 further comprising a second inner forming member.

25. The apparatus as claimed in claim 24 wherein said second inner forming member is movable in an axial direction.

26. The apparatus as claimed in claim 25 wherein said second inner forming member and said freely rotatable inner forming member are initially adjacent one another and said second inner forming member is capable of axial movement away from said freely rotatable inner forming member during a spin forming process.

27. The apparatus as claimed in claim 25 wherein said second inner forming member comprises a surface configured to cooperate with a forward sloping surface on said outer forming member to form a flange therebetween.

* * * * *

UNITED STATES PATENT AND TRADEMARK OFFICE

CERTIFICATE OF CORRECTION

PATENT NO. : 4,870,847
DATED : October 3, 1989
INVENTOR(S) : Martin P. Kitt

It is certified that error appears in the above—identified patent and that said Letters Patent is hereby corrected as shown below:

Column 4, line 62, delete "&:he" and substitute therefor --the--.

Column 8, line 8, insert --.-- after "object".

Column 8, line 19, delete "button" and substitute therefor --bottom--.

Column 8, line 50, after "in" insert --an axial direction and an outer forming means movable in--.

Column 8, line 50, delete "direction" and substitute therefor --directions--.

Column 8, line 59, delete "A" and substitute therefor --The--.

Signed and Sealed this

Thirty-first Day of July, 1990

*Attest:*

*Attesting Officer*

HARRY F. MANBECK, JR.

*Commissioner of Patents and Trademarks*